US007886704B2

(12) United States Patent
Friedrichs

(10) Patent No.: US 7,886,704 B2
(45) Date of Patent: Feb. 15, 2011

(54) APPARATUS FOR THE VARIABLE SETTING OF THE CONTROL TIMES OF GAS EXCHANGE VALVES OF AN INTERNAL COMBUSTION ENGINE

(75) Inventor: Matthias Friedrichs, Nuremberg (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 363 days.

(21) Appl. No.: 12/279,574

(22) PCT Filed: Jan. 19, 2007

(86) PCT No.: PCT/EP2007/050521

§ 371 (c)(1),
(2), (4) Date: Aug. 15, 2008

(87) PCT Pub. No.: WO2007/093480

PCT Pub. Date: Aug. 23, 2007

(65) Prior Publication Data

US 2009/0013948 A1 Jan. 15, 2009

(30) Foreign Application Priority Data

Feb. 18, 2006 (DE) ..... 10 2006 007 671

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

2005/0274345 A1* 12/2005 Dietz ..... 123/90.17

FOREIGN PATENT DOCUMENTS

| | | |
|---|---|---|
| DE | 8518157 | 11/1986 |
| DE | 10260546 | 7/2004 |
| EP | 1057981 | 12/2000 |
| EP | 0818609 | 10/2002 |
| EP | 1857644 | 11/2007 |
| GB | 2415745 | 1/2006 |
| JP | 2001263025 | 9/2001 |
| JP | 2005076482 | 3/2005 |
| WO | 2004057163 | 7/2004 |

* cited by examiner

*Primary Examiner*—Zelalem Eshete
(74) *Attorney, Agent, or Firm*—Volpe and Koenig, P.C.

(57) ABSTRACT

An apparatus (10) for the variable setting of control times of gas exchange valves (9*a*, 9*b*) of an internal combustion engine (1), having an inner rotor (23) and an outer rotor (22) which is arranged such that it can rotate relative to the former, and the inner rotor (22) has a constant phase relationship to a crankshaft (2) of the internal combustion engine (1). The apparatus (10) has one or more coupling elements (44), into which a drive shaft (12) of an additional assembly (11) can engage, and wherein torque can be transmitted from the apparatus (10) to the drive shaft (12) by the coupling element (44) or coupling elements (44). It is provided here to connect the coupling element (44) or coupling elements (44) fixedly in terms of rotation to the inner rotor (23) or to configure it/them in one piece with the inner rotor.

10 Claims, 5 Drawing Sheets

APPARATUS FOR THE VARIABLE SETTING OF THE CONTROL TIMES OF GAS EXCHANGE VALVES OF AN INTERNAL COMBUSTION ENGINE

BACKGROUND

The invention relates to an apparatus for the variable setting of control times of gas-exchange valves of an internal combustion engine with an inner rotor and an outer rotor, which is arranged so that it can rotate relative to the inner rotor, wherein the inner rotor has a constant phase relationship to a crankshaft of the internal combustion engine, wherein the apparatus has one or more coupling elements, in which a drive shaft of an auxiliary assembly can engage, and wherein torque can be transmitted from the apparatus to the drive shaft by the coupling element or coupling elements. In addition, the invention relates to an internal combustion engine with an apparatus for the variable setting of control times of gas-exchange valves and an auxiliary assembly, which is driven by a drive shaft by the apparatus.

It is generally known to someone skilled in the art of automotive engineering that, in addition to a plurality of assemblies, modern internal combustion engines are also equipped with an apparatus for the variable setting of control times of gas-exchange valves (camshaft adjuster), for example, an apparatus for the hydraulic rotational angle adjustment of the camshaft relative to the crankshaft, in order to be able to continuously change the opening and closing times of the gas-exchange valves of the internal combustion engine. In addition, auxiliary assemblies are provided, which are driven by the control drive of the internal combustion engine. Such auxiliary assemblies can be, for example, vacuum pumps for servo loads, for example, in order to generate the negative pressure necessary for a power brake booster of a motor vehicle.

The apparatuses typically used for rotational angle adjustment are here constructed, in principle, as a hydraulic adjustment drive, which is constructed either as a so-called axial-piston adjuster or similar to the apparatus known from EP 0 818 609 B1 as a so-called rotary piston adjuster. This apparatus is arranged on the drive-side end of the camshaft supported by several radial bearings in the cylinder head of the internal combustion engine and is made essentially from a drive unit in driven connection with the crankshaft of the internal combustion engine and from a driven unit locked in rotation with the camshaft of the internal combustion engine. The driven unit is here actually constructed as a vane wheel (called inner rotor below) and is attached to the camshaft by an axial central screw. The drive unit is constructed as a hollow cylinder (called outer rotor below) surrounding the driven unit, wherein this arrangement can be sealed tight against pressurized medium by two axial side walls. Through several radial limiting walls constructed on the outer rotor and several radial vanes constructed on or attached to the inner rotor, two pressure chambers, which can be charged selectively or simultaneously with a hydraulic pressurized medium and by which the outer rotor is connected in a force-transmitting way to the inner rotor, is formed between two limiting walls within the apparatus. Here, as a hydraulic pressurized medium for the apparatus, the lubricating oil of the internal combustion engine transmitted from one of the radial bearings of the camshaft or an oil distributor is used, which is fed by radial and axial oil channels to the apparatus.

Alternatively, the inner rotor can also be in driven connection with the crankshaft and the outer rotor can be locked in rotation with the camshaft. In another alternative embodiment, it can be provided that a first shaft is driven on one end, for example, by a chain, belt, or gearwheel, by the crankshaft. On the other end of this first shaft, a camshaft adjuster can be arranged, wherein the inner rotor is locked in rotation with the camshaft. In this case, a second shaft can be in driven connection, for example, by a chain, belt, or gearwheel, with the outer rotor of the camshaft adjuster, wherein this outer rotor can rotate relative to the inner rotor. Here, the first shaft can involve, for example, an intake camshaft (exhaust camshaft) and the second shaft can involve an exhaust camshaft (intake camshaft). In this case, the control times of the intake camshaft (exhaust camshaft) are selected as fixed times. The control times of the other camshaft, however, can be varied by the camshaft adjuster.

In contrast, the vacuum pumps typically used in internal combustion engines for a servo load are usually constructed as vane cell pumps, like those, for example, from DE 85 18 157 U1. This vacuum pump is arranged on a common longitudinal axis with the camshaft in the cylinder head of the internal combustion engine and is made essentially from a housing arranged stationary relative to the cylinder head or cylinder head cover of the internal combustion engine with a bearing journal and from a rotor arranged in the housing with a drive shaft, which is supported so that it can rotate in the bearing journal of the housing extending into the cylinder head of the internal combustion engine. Here, in the end side of the drive shaft, two recesses are machined, in which two coupling tabs formed on the end side of the camshaft engage and thus transfer the rotational movement of the camshaft to the drive shaft of the vacuum pump. In addition, the camshaft also has an axial lubricating oil channel, which leads to its end side and which is connected, on one side, via a coupling tube to an axial lubricating oil collection space in the drive shaft of the vacuum pump and, on the other side, to the lubricating oil circuit of the internal combustion engine, so that the vacuum pump is also lubricated with the lubricating oil of the internal combustion engine.

In DE 102 60 546 A1, an internal combustion engine is described, which is equipped both with an apparatus for the variable setting of the control times of gas-exchange valves and also with an auxiliary assembly. The auxiliary assembly, in this case a vacuum pump, is equipped with a drive shaft, which is locked in rotation by a coupling with the outer rotor or with components locked in rotation with the outer rotor. In addition, the auxiliary assembly is provided with lubricant by a connection tube via a channel constructed within the central screw.

This attachment of the drive shaft to the outer rotor or to components fixed to the outer rotor has proven to be disadvantageous for embodiments, in which the inner rotor is in a fixed phase relationship relative to the crankshaft of the internal combustion engine. In these embodiments, the inner rotor rotates with half the rotational speed of the crankshaft, wherein a fixed phase relationship is maintained. An outer rotor that can rotate relative to the inner rotor has no fixed phase relationship relative to the crankshaft during an adjustment process of the apparatus. Depending on the direction of adjustment, the outer rotor is temporarily accelerated or decelerated. In the case of a rotationally fixed connection between the outer rotor and the drive shaft of the auxiliary assembly, first, in this way, undesired rotational irregularities are fed via the drive shaft into the auxiliary assembly. Another serious disadvantage comes from the higher moment of inertia of the component to be adjusted. In this embodiment, because the component to be adjusted, the outer rotor, is connected rigidly to the drive shaft and thus, for example, to the rotor of a vane cell pump, during the adjustment process a significantly increased moment of inertia must be accelerated. This leads to a considerable reduction of the adjustment speed and the response behavior of the camshaft adjuster and thus, among other things, to increased emission values, lower power, and lower torque from the internal combustion engine.

Another disadvantage is the lubricant supply from the camshaft adjuster to the auxiliary assembly via components rotating relative to each other (central screw fixed to the inner rotor and drive shaft of the auxiliary assembly fixed to the outer rotor).

SUMMARY

The invention is based on the objective of overcoming these disadvantages and thus providing an apparatus for the variable setting of the control times of gas-exchange valves of an internal combustion engine, which is suitable for the steady driving of an auxiliary assembly, such as, for example, a vacuum pump, without causing negative effects on the adjustment speed and the response behavior of the apparatus.

This objective is met according to the invention by means of an apparatus according to the preamble of Claim 1 in such a way that the coupling element or coupling elements are locked in rotation with the inner rotor or are constructed in one piece with the inner rotor.

Due to the rotationally locked connection of the drive shaft of the auxiliary assembly with the inner rotor, which has a fixed phase relationship relative to the crankshaft in each operating state of the internal combustion engine, the moved mass of the auxiliary assembly is decoupled from the component to be adjusted, in this case, the outer rotor. Therefore, the auxiliary assembly does not negatively affect the adjustment speed and the response behavior of the adjuster and inertia-dependent overshoot of the phase position at the end of the adjustment process is prevented. Here it can be provided that the auxiliary assembly is a vacuum pump, for example, for a servo load.

In one embodiment of the invention, the inner rotor is fixed to the camshaft by a central screw. Here, it can be provided that the coupling element or coupling elements are constructed on the central screw.

In applications, in which the inner rotor is connected to the camshaft by a central screw, this embodiment represents an economical solution. The number of components does not increase and only slight modifications, for example, to the screw head, are needed, which can be realized in a cost-neutral way. Here, the coupling elements can be constructed, for example, as grooves on the screw head of the central screw. Alternatively, the coupling elements can be constructed as inner or outer keyed surfaces formed on the central screw, for example, its screw head.

Alternatively, a driver can be provided, which has the coupling element or coupling elements and which is constructed in one piece with the inner rotor or separately from the inner rotor and which is locked in rotation with the inner rotor.

Here it can be provided that the separate driver and the inner rotor are locked in rotation to the camshaft by a central screw.

In addition, the driver can have a pot-shaped construction, wherein the central screw passes through the base of the driver.

In applications, in which the rotor is accessible from the outside, the construction of the coupling elements directly on the rotor represents an economical solution. In these cases, at least the side cover facing away from the camshaft is constructed with a central borehole, which allows the driver or coupling elements constructed in one piece with the inner rotor to pass through this borehole in the axial direction. Alternatively, the coupling elements, for example, axially extending pins, pass through the side cover in the region of grooves extending in the peripheral direction.

The coupling elements can already be taken into account in a cost-neutral way in the shaping tool, for example, in a sintered form.

In the case of inner rotors that are hard to access from the outside, the drive shaft of the auxiliary assembly can be driven by one or more drivers constructed separately from the inner rotor, wherein the driver or drivers are locked in rotation with the inner rotor. An economical solution can be realized by the attachment of the driver via the central screw, which connects the inner rotor to the camshaft in a rotationally fixed way. Here, the driver is arranged in the press-fit connection of the screw, inner rotor, and camshaft. Due to the construction of the driver by a non-cutting shaping process from a sheet-metal part, this can be produced economically.

The coupling elements can have a plurality of constructions. An economical embodiment can be realized, for example, in such a way that the coupling element or coupling elements are formed as grooves or projections, which are complementary to projections or grooves on the drive shaft.

In the case of an apparatus, whose inner rotor is attached by of a central screw to the camshaft, it can be provided that the central screw is formed with an essentially axial lubricant channel, to which lubricant can be fed on the camshaft side, wherein, in the region of the coupling element or coupling elements, at least one discharge opening is provided, which opens into a receptacle opening. This discharge opening can be constructed, for example, in the center on the screw head of the central screw. A connection tube, which is arranged within the drive shaft and which also has a lubricant channel, can engage in the receptacle opening in this embodiment, by which the supply of lubricant of the auxiliary assembly can be guaranteed. Here, the outer contours of the connection tube can be adapted to the inner contours of the receptacle opening, by which leakage is prevented. In cases, in which the connection tube and the drive shaft of the auxiliary assembly are constructed in one piece or are locked in rotation with each other, relative movement of the outer contours of the connection tube relative to the inner contours of the receptacle opening of the lubricant channel is prevented. Therefore, wear and thus lubricant leakage at this connection point are prevented.

In internal combustion engines with an apparatus for the variable setting of the control times of gas-exchange valves of the internal combustion engine and an auxiliary assembly, which is driven by a drive shaft via the apparatus, according to the invention it is provided that the apparatus is constructed according to one of the embodiments described above.

BRIEF DESCRIPTION OF THE DRAWINGS

Additional features of the invention emerge from the following description and the associated drawings, in which embodiments of the invention are shown schematically. Shown are.

DETAILED DESCRIPTION OF THE PREFERRED EMBODIMENTS

Figure 1:
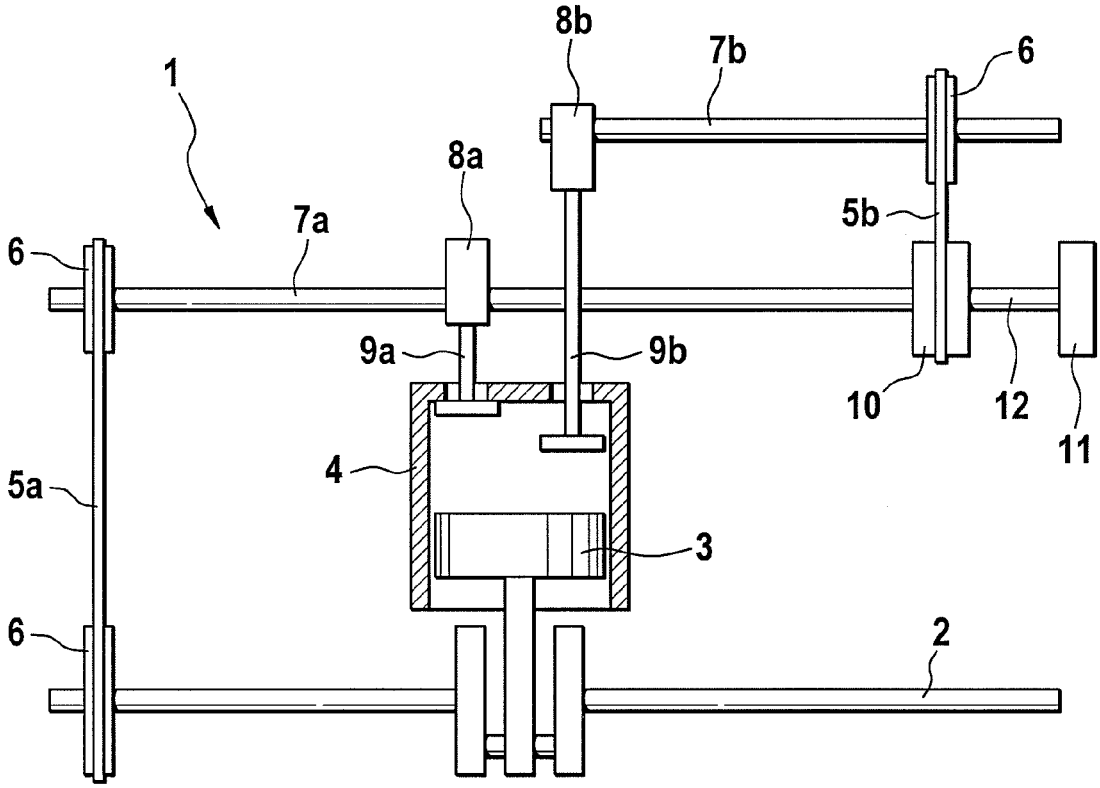
FIG. 1 is a schematic view of an internal combustion engine.

In FIG. 1, an internal combustion engine 1 is sketched as an example, in which an apparatus 10 according to the invention can be applied. Here, a piston 3 connected to a crankshaft 2 is indicated in a cylinder 4. The crankshaft 2 is in driving connection with an intake camshaft 7*a* in the shown embodiment by a first traction mechanism drive 5*a* and two gearwheels 6. On the end of the intake camshaft 7*a* facing away from the drive side, an apparatus 10 for the variable setting of the control times of gas-exchange valves 9*a*, 9*b* is arranged on this intake camshaft. The apparatus 10 drives an exhaust camshaft 7*b* via a second traction mechanism drive 5*b*. Cams 8*a*, 8*b* of the camshafts 7*a*, 7*b* activate an intake gas-exchange valve 9*a* or an exhaust gas-exchange valve 9*b*.

Torque is transmitted from the crankshaft 2 via the first traction mechanism drive 5*a* to the intake camshaft 7*a*, which is in a fixed phase relationship to the crankshaft 2. Through use of the apparatus 10, the second traction mechanism drive 5*b*, and a gearwheel 6, the exhaust camshaft 7*b* is driven, wherein the control times of the exhaust gas-exchange valve 9*b* can be varied by the apparatus 10.

With 11, an auxiliary assembly, for example, a vacuum pump for a servo load, for example, a braking force booster, is designated. The auxiliary assembly 11 has a drive shaft 12, which is driven by the apparatus 10.

The apparatus 10 according to the invention can also be used in other internal combustion engines 1, for example, in internal combustion engines 1, in which an arbitrary camshaft 7*a*, 7*b* is driven by a traction mechanism drive 5*a*, wherein an inner rotor of the apparatus 10 is in direct drive connection with the traction mechanism drive 5*a* and an outer rotor is locked in rotation with the camshaft 7*a*, 7*b*.

Figure 2A:
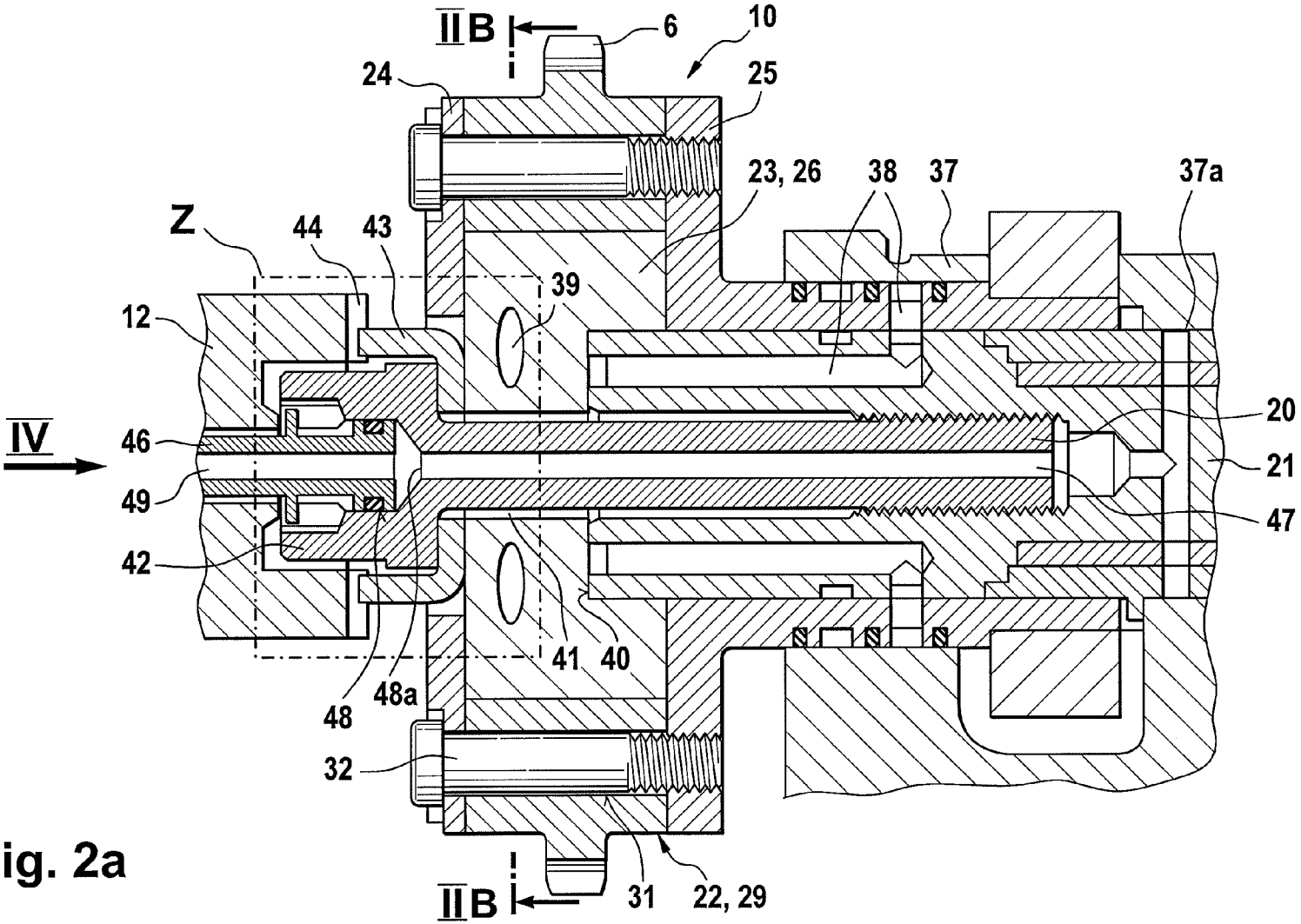
FIG. 2*a* is a longitudinal section view through a first construction according to the invention for an apparatus, which is locked in rotation by a central screw to a camshaft.
Figure 2B:
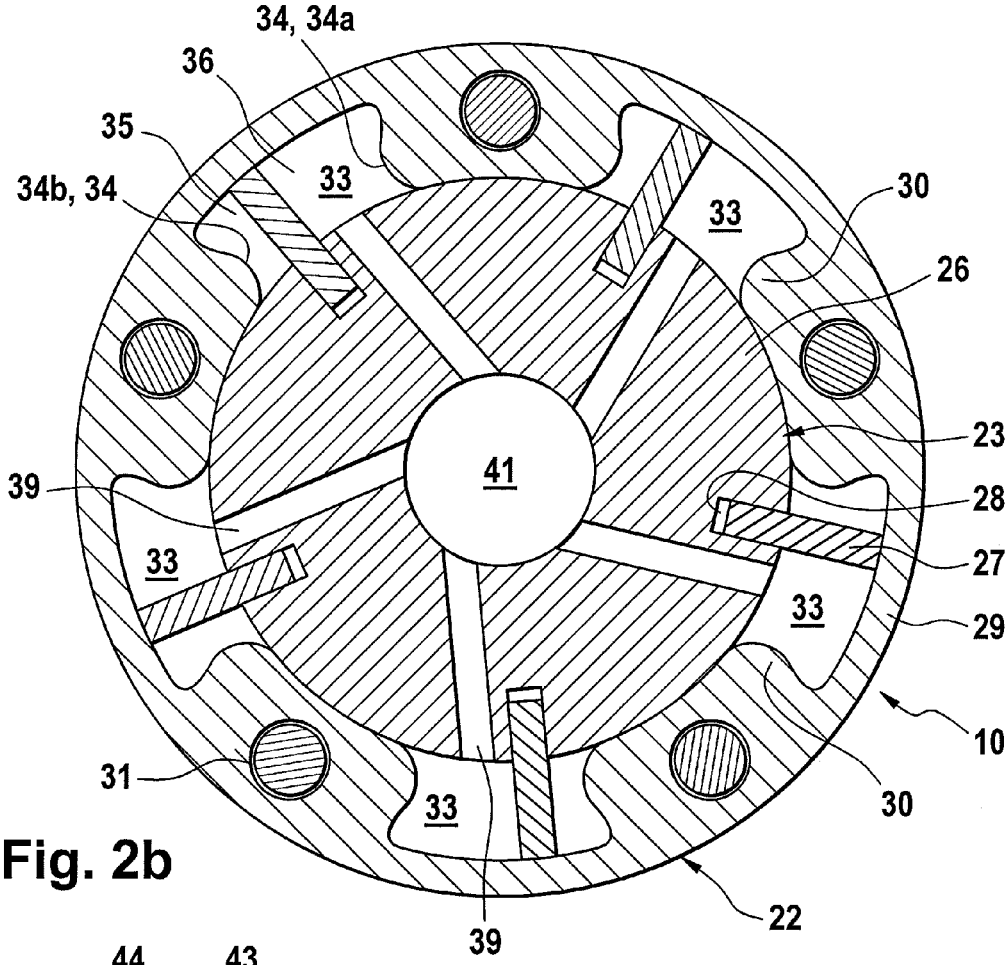
FIG. 2*b* is a cross sectional view through the apparatus from FIG. 2*a* along the line IIB-IIB.

FIG. 2*a* shows a first embodiment of an apparatus 10 according to the invention in longitudinal section. The apparatus 10 is attached to a camshaft 21 by a central screw 20. In addition, a section of the drive shaft 12 of the auxiliary assembly 11 is shown. In FIG. 2*b*, the apparatus 10 is shown in cross section.

The apparatus 10 has an outer rotor 22, an inner rotor 23, and two side covers 24, 25. In the illustrated embodiment, the inner rotor 23 is locked in rotation by the central screw 20 with the camshaft 21, which is driven at its other end by the crankshaft 2.

The inner rotor 23 has at least one essentially cylindrical hub element 26, from whose outer cylindrical surface, at least one vane, and in the illustrated embodiment five vanes 27 extend outwardly in the radial direction. Here, the vanes 27 can be constructed in one piece with the hub element 26. Alternatively, the vanes 27, as shown in FIG. 2*b*, can be constructed separately and can be arranged in axial vane grooves 28 formed on the hub element 26, wherein the vanes 27 are accelerated outward in the radial direction with a force by not-shown spring elements arranged between the groove bases of the vane grooves 28 and the vanes 27.

Starting from an outer peripheral wall 29 of the outer rotor 22, several projections 30 extend inward in the radial direction. In the shown embodiment, the projections 30 are constructed in one piece with the peripheral wall 29. However, embodiments, in which, instead of the projections 30, vanes are provided that are formed on the peripheral wall 29 and that extend inward in the radial direction, are also conceivable. The outer rotor 22 is supported on the inner rotor 23 so that it can rotate relative to this inner rotor via the radial, inner peripheral walls of the projections 30.

On an outer surface of the peripheral wall 29, a chain wheel 6 is formed, by which a second, not-shown camshaft can be driven by a similarly not-shown chain drive. Alternatively, a belt or a toothed wheel drive can also be provided.

Each of the side covers 24, 25 is arranged on and fixed to one of the axial side surfaces of the outer rotor 22. For this purpose, in each of the projections 30 there is an axial opening 31, wherein each axial opening 31 is passed through by an attachment element 32, for example, a bolt or a screw, which is used for rotationally fixed connection of the side cover 24, 25 to the outer rotor 22.

Within the apparatus 10, a pressure space 33 is formed between every two projections 30 adjacent in the peripheral direction. Each pressure space is defined in the peripheral direction by opposing, essentially radial limiting walls 34 of adjacent projections 30, in the axial direction by the side covers 24, 25, radially inward by the hub element 26, and radially outward by the peripheral wall 29. In each of the pressure spaces 33, a vane 27 projects, wherein the vanes 27 are constructed in such a way that these contact both the side walls 24, 25 and also the peripheral wall 29. Each vane 27 thus divides each pressure space 33 into two counteracting pressure chambers 35, 36.

The outer rotor 22 is arranged so that it can rotate relative to the inner rotor 23 within a defined angular range. The angular range is limited in a rotational direction of the outer rotor 22 in such a way that at least one of the vanes 27 comes in contact with a limiting wall 34 of the pressure space 33 formed as an advanced stop 34*a*. Analogously, the angular range in the other rotational direction is limited in such a way that at least one vane 27 comes in contact with the other limiting wall 34, which is used as a retarded stop 34*b*. Alternatively, a rotational limiting apparatus could be provided, which limits the rotational angle range of the outer rotor 22 relative to the inner rotor 23.

By pressurizing one of the pressure chambers 35, 36 and releasing pressure from the other pressure chamber 35, 36, the phase position of the outer rotor 22 relative to the inner rotor 23 can be varied. By pressurizing both pressure chambers 35, 36, the phase position of the two rotors 22, 23 can be held constant relative to each other. As a hydraulic pressure medium, in the shown embodiment, the lubricant oil of the internal combustion engine 1 removed from an oil distributor 37 is used. This is led from the oil distributor 37 via radial and axial oil channels 38 within the camshaft 21 and via radial pressure means lines 39, which are formed on the inner rotor 23, to the pressure chambers 35, 36.

Figure 3:
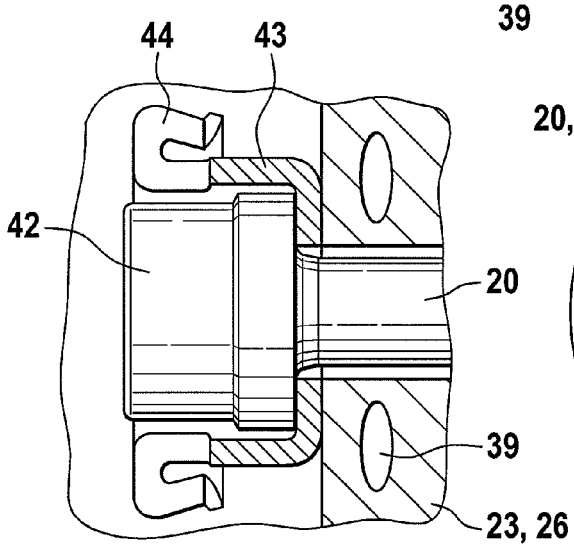
FIG. 3 is an enlarged view of the detail Z from FIG. 2*a*.
Figure 4:
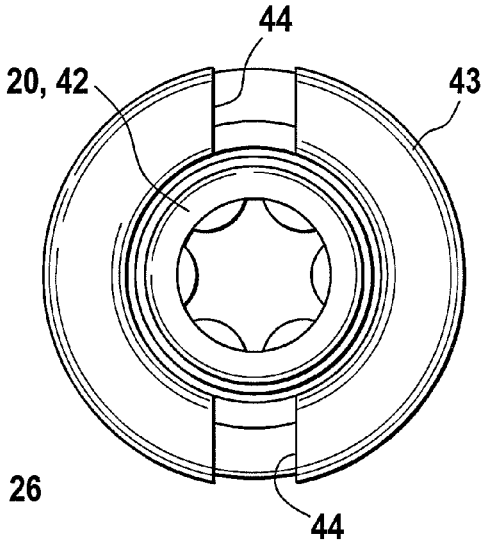
FIG. 4 is a top view of the driver and the central screw along the arrow IV in FIG. 2*a*.

The inner rotor 23 is attached by the central screw 20 to the camshaft 21. For this purpose, the inner rotor 23 is formed with a shoulder 40, in which the camshaft 21 engages. The central screw 20 passes through a recess 41 formed on the inner rotor 23 and is screwed with the camshaft 21 in a rotationally fixed way. Through the use of a screw head 42 of the central screw 20, a press-fit connection is produced between the central screw 20, the inner rotor 23, and the camshaft 21 and thus the inner rotor 23 is locked in rotation with the camshaft 21 by a friction force-fit connection. Within this press-fit connection, a driver 43 is arranged. The driver 43 is constructed as a pot-shaped component, which is produced, for example, from a steel sheet by a non-cutting shaping process. The central screw 20 passes through the base of the pot-shaped driver 43 and connects this driver to the inner rotor 23 in a rotationally fixed way. The driver 43 and the screw head 42 of the central screw 20 are shown in enlarged form in FIGS. 3 and 4. As can be clearly seen in the figures, on the driver 43, coupling elements 44 are formed, in which complementary coupling elements of the drive shaft 12 of the auxiliary assembly 11 can engage. In the shown embodiment, the coupling elements 44 are constructed as slits or grooves in a circular, surrounding edge of the driver 43 formed with a U-shaped cross section. As can be seen in FIG. 2*a*, complementary coupling elements of the drive shaft 12 of the auxiliary assembly 11 engage in the coupling elements 44. Thus, a rotationally fixed connection is created between the drive shaft 12 and the inner rotor 23.

The lubrication of the auxiliary assembly 11 is realized in this embodiment by a connection tube 46 arranged within the drive shaft 12. For this purpose, the central screw 20 is formed with an axial lubricant channel 47, which is charged with lubricant on one end by a radial bearing 37*a*. The screw head 42 is provided with a receptacle opening 48, in which one end of the connection tube 46 engages in a sealed way. The lubricant channel 47 opens via a discharge opening 48*a* into the receptacle opening 48. Within the connection tube 46, another lubricant channel 49 is formed, by which lubricant coming from the lubricant channel 47 into the receptacle opening 48 can reach the auxiliary assembly 11.

Alternatively, the lubricant supply to the auxiliary assembly 11 can also be realized, for example, directly via a housing of the auxiliary assembly 11.

Figure 5:
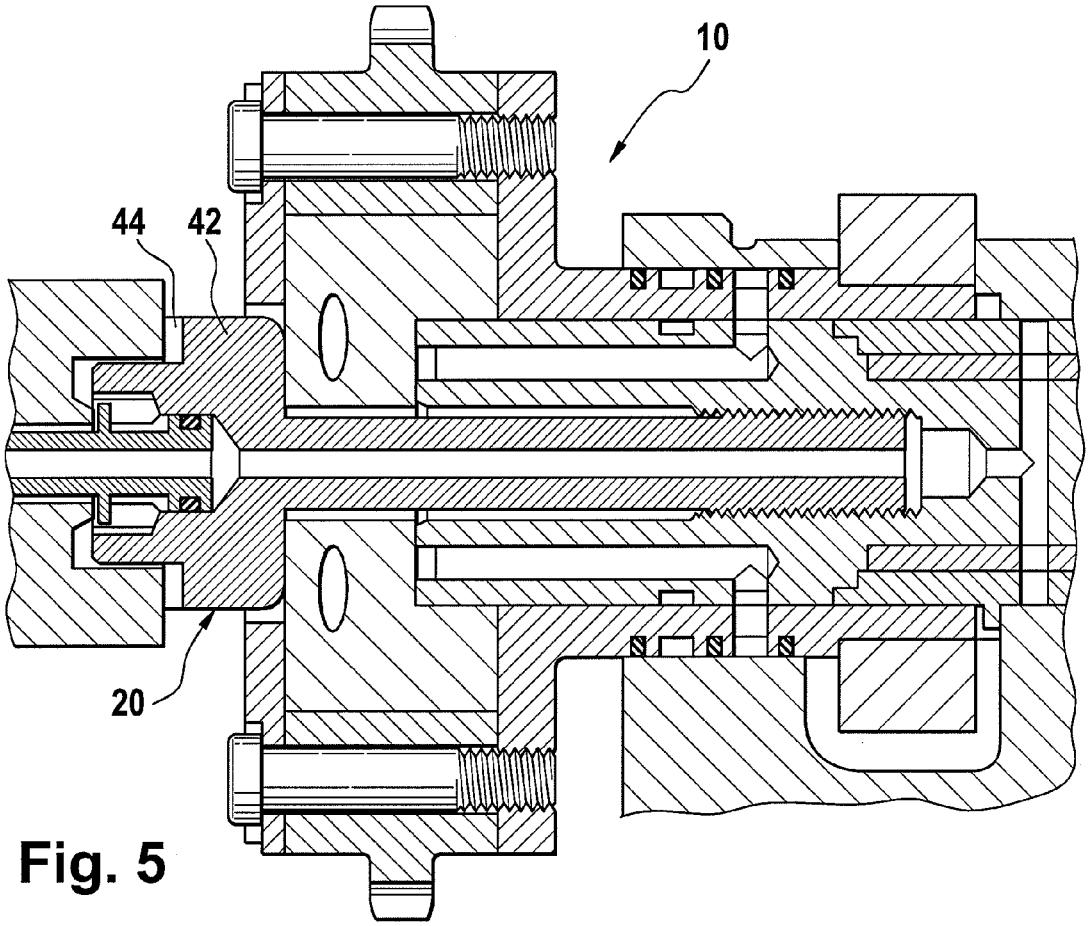
FIG. 5 is a longitudinal section view through a second construction of an apparatus according to the invention.
Figure 6:
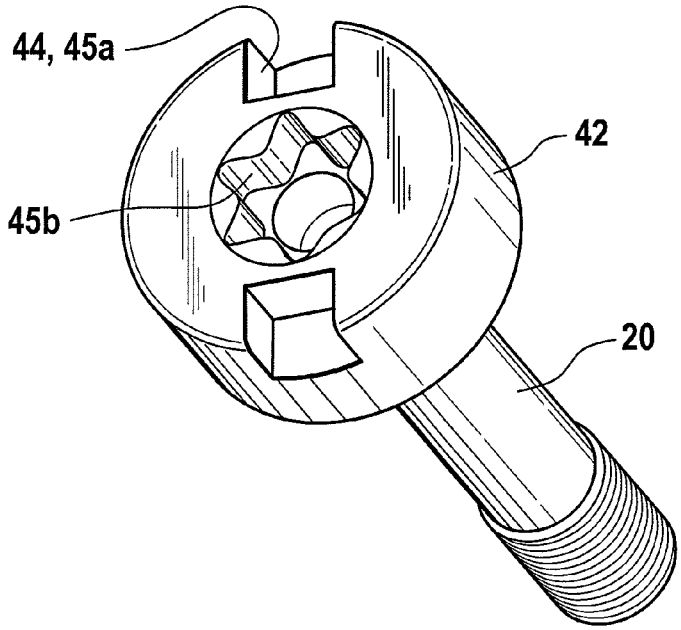
FIG. 6 is a perspective view of a central screw of the apparatus shown in FIG. 5.

FIG. 5 shows a second embodiment of an apparatus 10 according to the invention. This embodiment is identical, in most aspects, to the embodiment shown in FIG. 2*a*. In contrast to the first embodiment, here, the driver 43 was eliminated and the coupling element 44, as shown in FIG. 6, is machined directly into the screw head 42 of the central screw 20. The coupling elements 44 can be formed, for example, as grooves 45*a* on the outer periphery of the central screw 20 or as inner or outer keyed surfaces 45*b* on the screw head 42 of the central screw 20.

Figures 7, 8:
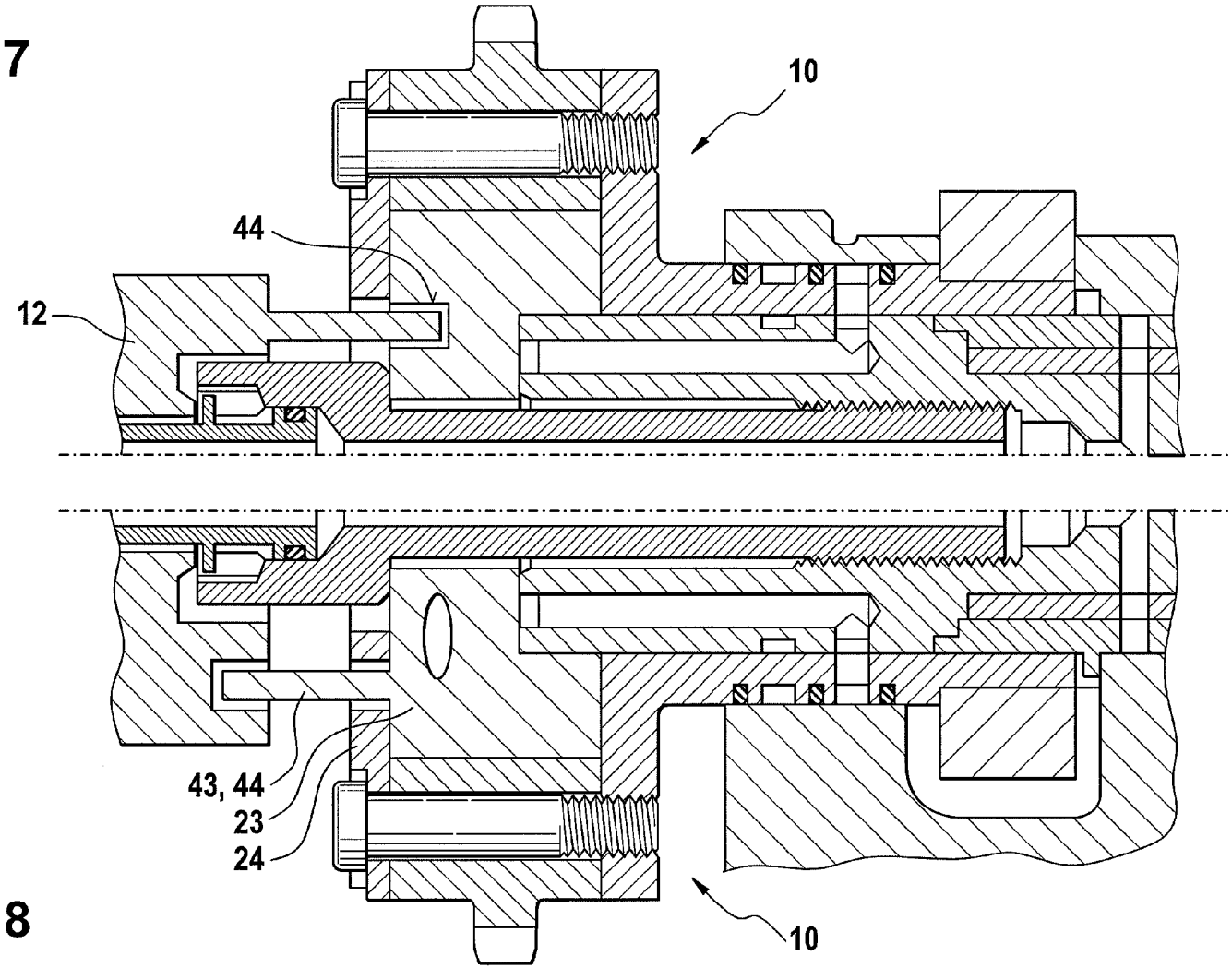
FIG. 7 is a longitudinal section view through a third construction of an apparatus according to the invention.
FIG. 8 is a longitudinal section view through a fourth construction of an apparatus according to the invention.

FIGS. 7 and 8 show additional embodiments of an apparatus 10 according to the invention. These are formed, in most aspects, identical to the first embodiment, with the difference that the coupling elements 44 are formed in one piece with the inner rotor 23.

In the embodiment shown in FIG. 7, the coupling elements 44 are formed as pocket receptacles, which are formed on an axial side surface of the inner rotor 23. Pegs formed on the drive shaft 12 engage in these receptacles.

In the embodiment shown in FIG. 8, a driver 43, on which the coupling elements 44 are formed, or coupling elements 44 themselves are formed in one piece with the inner rotor 23. The driver 43 or the coupling elements 44 formed, for example, as pegs, pass in the axial direction through elongated holes extending in the peripheral direction and formed on the side cover 24 facing away from the camshaft, wherein the coupling elements 44, for example, pins, engage in complementary coupling elements of the drive shaft. Alternatively, the coupling elements can also pass through a central opening of the side cover 24 facing away from the camshaft in the axial direction.

The application of the invention is not limited to the shown embodiment of a camshaft adjuster. Use of the invention on an axial piston adjuster is also conceivable, wherein, in this case, the inner rotor 23 is formed as an element fixed to the camshaft and the outer rotor 22 is formed as an element that can rotate relative to this outer rotor. The use of the invention in electromechanical adjusters is also conceivable, in which the adjustment between the outer rotor 22 and inner rotor 23 is realized by a mechanical gear drive, for example, a planetary gear, an inner eccentric gear, a wobble-plate gear, harmonic-drive gearing, or similar gearing, with the help of an electrical drive. Here, the inner rotor 23 can be formed as a gear element fixed to the camshaft and the outer rotor 23 can be formed as a gear element that can rotate relative to this inner rotor.

REFERENCE SYMBOLS

1 Internal combustion engine
2 Crankshaft
3 Piston
4 Cylinder
5*a* Traction mechanism drive
5*b* Traction mechanism drive
6 Gearwheel
7*a* Intake camshaft
7*b* Exhaust camshaft
8*a* Cam
8*b* Cam
9*a* Intake gas-exchange valve
9*b* Exhaust gas-exchange valve
10 Apparatus
11 Auxiliary assembly
12 Drive shaft
20 Central screw
21 Camshaft
22 Outer rotor
23 Inner rotor
24 Side cover
25 Side cover
26 Hub element
27 Vane
28 Vane grooves
29 Peripheral wall
30 Projection
31 Axial opening
32 Attachment opening
33 Pressure space
34 Limiting wall
34*a* Advanced stop
34*b* Retarded stop
35 Pressure chamber
36 Pressure chamber
37 Oil distributor
37*a* Radial bearing
38 Oil channel
39 Pressure means line
40 Shoulder
41 Recess
42 Screw head
43 Driver
44 Coupling elements
45*a* Groove
45*b* Keyed surfaces
46 Connection tube
47 Lubricant channel
48 Receptacle opening
48*a* Discharge opening
49 Lubricant channel

The invention claimed is:

1. Apparatus for the variable setting of control times of gas-exchange valves of an internal combustion engine comprising:

an inner rotor and an outer rotor that can rotate relative to the inner rotor, the inner rotor has a constant phase relationship relative to a crankshaft of the internal combustion engine, at least one coupling element, in which a drive shaft of an auxiliary assembly can engage, and, through use of the at least one coupling element, torque can be transmitted from the apparatus to the drive shaft, the at least one coupling element is locked in rotation with the inner rotor or formed in one piece with the inner rotor.

2. Apparatus according to claim 1, wherein the auxiliary assembly is a vacuum pump.

3. Apparatus according to claim 1, wherein the inner rotor is attached by a central screw to a camshaft and the at least one coupling element is formed on the central screw.

4. Apparatus according to claim 1, wherein a driver is provided, which has the at least one coupling element and which is constructed in one piece with the inner rotor or separately from the inner rotor and locked in rotation with the inner rotor.

5. Apparatus according to claim 4, wherein the separate driver and the inner rotor are attached by a central screw to a camshaft.

6. Apparatus according to claim 5, wherein the driver has a pot-shaped construction, and the central screw passes through a base of the driver.

7. Apparatus according to claim 6, wherein the driver is produced from a sheet-metal part by a non-cutting shaping process.

8. Apparatus according to claim 1, wherein the at least one coupling element is formed as grooves or projections, which are formed complementary to projections or grooves on the drive shaft.

9. Apparatus according to claim 3, wherein the central screw is formed with an essentially axial lubricant channel, to which lubricant can be fed on a camshaft side, and at least one discharge opening is provided in a region of the at least one coupling element.

10. Internal combustion engine with an apparatus for the variable setting of control times of gas-exchange valves of the internal combustion engine and an auxiliary assembly, which is driven by a drive shaft via the apparatus, wherein the apparatus comprises:

an inner rotor and an outer rotor that can rotate relative to the inner rotor, the inner rotor has a constant phase relationship relative to a crankshaft of the internal combustion engine, at least one coupling element, in which a drive shaft of an auxiliary assembly can engage, and, through use of the at least one coupling element, torque can be transmitted from the apparatus to the drive shaft, the at least one coupling element is locked in rotation with the inner rotor or formed in one piece with the inner rotor.

* * * * *